United States Patent [19]

Küpfer et al.

[11] 4,405,340

[45] Sep. 20, 1983

[54] PROCESS AND APPARATUS FOR CHARGING SOLID FUELS INTO A FIXED-BED GASIFIER

[75] Inventors: Hans Küpfer, Frankfurt am Main; Paul Rudolph, Bad Homburg, both of Fed. Rep. of Germany

[73] Assignee: Metallgesellschaft Aktiengesellschaft, Frankfurt am Main, Fed. Rep. of Germany

[21] Appl. No.: 272,429

[22] Filed: Jun. 10, 1981

[30] Foreign Application Priority Data

Sep. 2, 1980 [DE] Fed. Rep. of Germany ..... 3032949

[51] Int. Cl.[3] ..... C10J 3/30

[52] U.S. Cl. ..... 48/86 R; 48/73; 48/77; 414/160

[58] Field of Search ..... 48/86 R, 73, 63, 64, 48/77; 266/184; 414/160, 162, 206, 208, 301

[56] References Cited

U.S. PATENT DOCUMENTS

| | | | |
|---|---|---|---|
| 2,654,594 | 10/1953 | Somogyi | 414/160 |
| 3,799,368 | 3/1974 | Wieczorek | 414/206 |
| 4,029,220 | 6/1977 | Greaves | 414/206 |
| 4,040,800 | 8/1977 | Rudolph et al. | 48/86 R |

FOREIGN PATENT DOCUMENTS

| | | | |
|---|---|---|---|
| 850306 | 12/1939 | France | 48/86 R |
| 305721 | 2/1933 | Italy | 48/86 R |
| 341587 | 1/1931 | United Kingdom | 414/206 |

*Primary Examiner*—Peter F. Kratz

*Attorney, Agent, or Firm*—Sprung, Horn, Kramer & Woods

[57] ABSTRACT

The apparatus serves to continuously charge coarse-grained and fine-grained solid fuels by means of a rotary distributor onto a fixed bed of fuel. The fixed bed is disposed within a reactor for gasifying the fuels. Gasifying agents comprising oxygen, steam and/or carbon dioxide are passed through the fixed bed from below. Residual matter left after the gasification is withdrawn under the fixed bed as solid ash or liquid slag. Fine-grained fuel having a mean particle size up to 5 mm are placed onto the fixed bed as helical layers separately form more coarsely grained fuel having a mean particle size above 5 mm. The more coarsely grained fuel is deposited directly on fine-grained fuel which has just been deposited.

The gasifier comprises a rotary distributor that includes at least one passage for the fine-grained fuel and at least one passage for the more coarsely grained fuel. The inlet of the passage for fine-grained fuel is disposed near the center of the rotary distributor. The inlet of the passage for the more coarsely grained fuel is disposed near the periphery of the rotary distributor.

5 Claims, 3 Drawing Figures

PROCESS AND APPARATUS FOR CHARGING SOLID FUELS INTO A FIXED-BED GASIFIER

BACKGROUND OF THE INVENTION

1. Field of the Invention

This invention relates to a process for charging coarse-grained and fine-grained, solid fuels by means of a rotary distributor continuously onto a fixed bed in a reactor used to gasify the fuels with gasifying agents which are passed through the fixed bed from below and comprise oxygen, steam and/or carbon dioxide, wherein residual matter left after the gasification is withdrawn under the fixed bed as solid ash or liquid slag, and to apparatus for carrying out that process.

2. Discussion of Prior Art

The gasification of coal in a fixed bed is known, e.g., from U.S. Pat. No. 3,540,867 and 3,854,895. A gasification involving a withdrawal of liquid slag has been explained in British Pat. Nos. 1,507,905; 1,508,671; and 1,512,677.

The gasifying process described first hereinabove and apparatus for carrying out that process have been described in the above-mentioned publications as well as in German Pat. No. 2,353,241 and the corresponding U.S. Pat. No. 3,951,616. For a troublefree operation of the gasifier which has been described, it is recommended to charge the fixed bed only with relatively coarse-grained fuel having a particle size range of about 3 to 100 mm and preferably 4 to 50 mm. If the coal to be gasified has an excessively high content of fine-grained material or dust, the gasifying agents will not flow through the fixed bed in a uniform distribution due to the fact that the fine-grained fuel differs in trickling behavior from coarse-grained fuel and a segregation takes place as the fuel is introduced into the reactor through a lock chamber. As a result, the fixed bed of coal disposed in the gasification zone has regions in which fine-grained fuel is contained in a relatively high proportion. Such regions have a poor permeability for the gasifying agents and the product gases.

SUMMARY OF THE INVENTION

It is an object of the invention to permit a gasification also of very fine-grained to dustlike coal together with more coarsely grained coal in a fixed bed. Specifically, it should be possible to subject coal having an as-mined particle size distribution to gasification in a fixed bed. This object is accomplished in that the fine-grained fuels having a mean particle size up to about 5 mm is placed on the fixed bed in the form of a helical layer separately from the more coarsely grained fuel having a mean particle size above about 5 mm. The mean particle size referred to here is calculated on the basis of proportions by weight. The more finely grained fuel is separately deposited in a layer which is as uniformly as possible in thickness so that irregularities in the resistance presented by that layer to the flow of the gasifying agents and products gases will be avoided.

More coarsely grained fuel is suitably deposited directly on fine-grained fuel which has just been deposited. This measure will prevent a raising and entraining of fine-grained fuel from the layer by the rising gases.

In accordance with an important variant of the invention, the fact that the larger fuel particles are more easily moved in an outward direction over the rotary distributor is utilized to separate the finer fuel particles from the more coarser ones. The resulting separation is not as strict and selective as a separation effected by means of a sieve but is adequate for the gasification.

The invention includes also an apparatus for carrying out the process described first hereinbefore. In one embodiment of said apparatus the rotary distributor disposed between the lock chamber for the coal and the fixed bed of the gasifier comprises at least one passage for the fine-grained fuels. That passage has an inlet near the center of the rotary distributor. The rotary distributor comprises at least one additional passage for more coarsely grained fuels; the latter passage has an inlet near the periphery of the rotary distributor. The more coarsely grained coal which owing to its hight ability to roll and trickle will become enriched near the periphery of the rotary distributor will, as a result of that arrangement, be placed as a separate layer on the fixed bed.

BRIEF DESCRIPTION OF DRAWINGS

Further details of the process and possible further preferred features of apparatus for carrying out the process will be explained with reference to the diagrammatic drawing, in which.

DESCRIPTION OF SPECIFIC EMBODIMENTS

Figure 1:
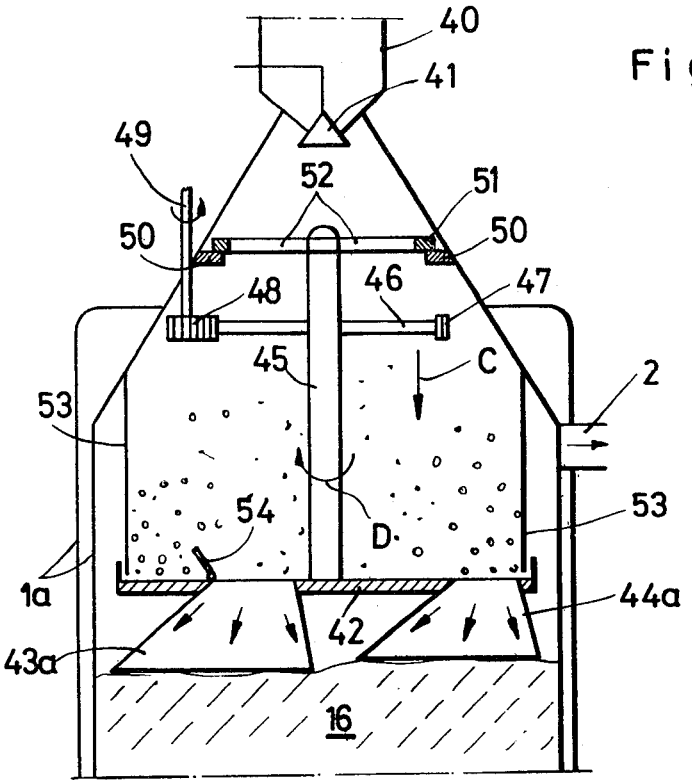
FIG. 1 is a longitudinal sectional view showing the charging portion of a gasifying reactor.

The upper portion of a gasifying reactor shown in FIG. 1 comprises a shell 1*a*, which consists of a water-cooled jacket. The reactor may be designed to withstand superatmospheric pressures up to about 150 bars. The shell 1*a* is provided with the product gas outlet 2. The reactor carries a lock chamber 40 for coal with the movable lock chamber valve 41. The coal in the lock chamber has a very large particle size range and comprises dustlike and pulverulent particles as sell as fine-grained and coarse-grained coals having particle diameters up to about 100 mm.

Figure 2:
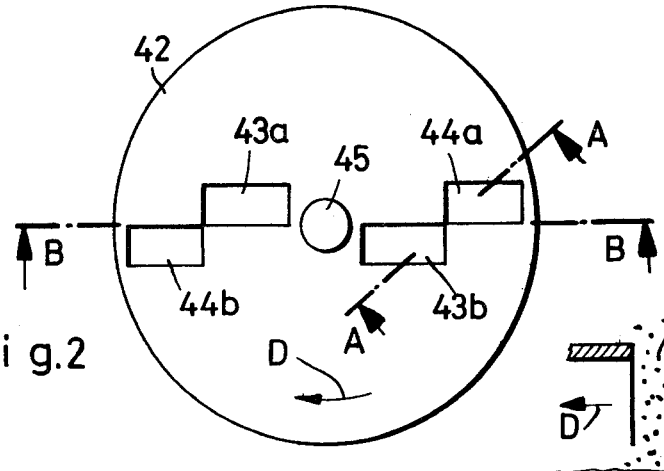
FIG. 2 is a top plan view showing the rotary distributor disk of FIG. 1.

The rotary distributor disposed below the lock chamber 40 comprises a distributor disk 42 having four outlet passages 43*a*, 43*b*, 44*a*, 44*b*. As FIG. 1 is substantially a longitudinal sectional view taken on line B—B in FIG. 2, only the two outlet passages 43*a* and 44*a* are seen in FIG. 1. FIG. 2 shows the distributor disk 42 in a top plan view taken in the direction of the arrow C in FIG. 1.

The rotary distributor comprises a central shaft 45, which is connected at its lower end to the distributor disk 42. For driving the rotary distributor, the shaft 45 is connected by spokes 46 to a ring gear 47, which is in mesh with a pinion 48. A motor, not shown, rotates the pinion 48 by means of its shaft 49.

The rotary distributor is mounted on a stationary bearing ring 50 by another bearing ring 51. The bearing ring 51 is connected by several spokes 52 to the central shaft 45. During the gasifying operation, the valve 41 is opened in intervals of time, which depend on the gasification rate, to permit coal to fall from the lock chamber 40 into the rotary distributor. This results in the formation of a conical pile on the distributor plate 42. A stationary cylinder 53 prevents coal from falling over the rim of the disk 42. When the disk 42 is constantly rotated in the sense indicated by the arrow D, the coal can constantly flow to the fixed bed 16 of coal through the outlet passages 43*a*, 43*b*, 44*a* and 44*b*.

Because fine-grained coal cannot or can hardly roll or trickle outwardly, it will accumulate in the inner portion, around the shaft 45, of the pile which is being formed on the rotating disk 42. On the other hand, coarse-grained coal will roll down more easily on the periphery of the onical pile which is being formed so that coarse-grained coal will be enriched in the outer portions of the cone near the cylinder 53. As a result, the two passages 43*a* and 43*b* having inlets close to the shaft 45 will mainly deliver fine-grained coal to the fixed bed 16 whereas the more coarsely grained coal will flow down through the two passages 44*a* and 44*b* having inlets in the outer portion of the rotary disk. Only the inlets of these four passages are seen in FIG. 2. It is apparent from FIG. 1 that the outlets of the outlet passages 43*a* and 44*a* for filling up the fixed bed 16 to be gasified are wider than the respective inlets. As a result, the fixed bed 16 can be covered throughout its radial width in a virtually uniform distribution with fresh coal to be gasified.

FIG. 1 shows an adjusting plate 54, which is angularly movable about a pivot that is connected to the distributor disk 42. It is apparent that the regions from which fine-grained coal is received by the passage 43*a* and coarse-grained coal is received by the passage 44*b* can be controlled in this manner. For the sake of clarity, pivoted adjusting plate 54 has not been shown in FIG. 2.

It is apparent from the foregoing that the selectivity of the separation of the fine-grained and coarse-grained coals in the pile above the distributor plate 42 will increase with the ability of the coarse-grained coal to roll outwardly. For this reason it will be suitable to feed fresh coal from the lock chamber 40 into the rotary distributor when the conical pile over the disk 42 has settled to a substantial extent. For the same reason it is desirable to maintain a certain vertical spacing between the outlet of the lock chamber 40 and the upper limit for the apex of the conical pile.

Figure 3:
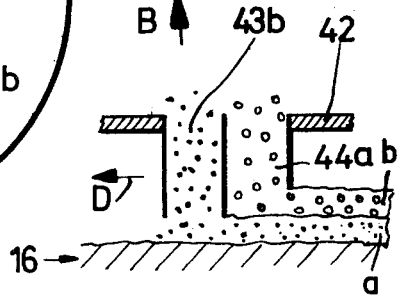
FIG. 3 is a sectional view taken on line A—A in FIG. 2.

It is apparent from FIGS. 2 and 3 that the passages 43*a* and 43*b* for delivering fine-grained coal precede the passages 44*a* and 44*b* for coarse-grained coal. As a result, the fine-grained layer a is initially deposited on the fixed bed to be gasified, which settles continuously as a result of the continuous gasifying reactions. The layer a is then covered by a layer b of coarse-grained coal, which is delivered from the outlet of the succeeding passage 44*a* or 44*b*. It is apparent from FIG. 3 that the height of the layer b will depend on the vertical spacing of the outlets of the passages 43*b* and 44*a*. The height of the fine-grained layer a will depend on the extent to which the fixed bed 16 has settled since the last charging of coal. For this reason the height of the layer a can be controlled by a control of the speed of the distributor disk 42. As the height of the layer b does not depend on said speed, the speed of the disk 42 can be varied to control the ratio of fine-grained coal to coarse-grained coal deposited on the bed 16.

What is claimed is:

1. In a reactor for the gasification of solid carbonaceous fuel with oxygen, steam and/or carbon dioxide as gasifying agents, said fuel having a grained-sized distribution from dust like grains to a grain size of more than 3 mm. up to 100 mm., in said reactor said fuel forming a fixed bed and the gasifying agents passing upwardly through said fixed bed, within said reactor in its upper portion above said fixed bed a disc-shape distributor being horizontally disposed, means for rotating said distributor about a vertical axis, means for feeding said fuel from above to fall on fuel on said distributor, and a stationary cylindrical wall surrounding the fuel on said distributor, said wall having about the same diameter as the distributor, the improvement wherein said distributor has at least one inner passage and one outer passage for fuel to flow on said fixed bed, each passage having an inlet remote from said fixed bed and an outlet close to said fixed bed, the inlet of the outer passage being disposed near the periphery of said distributor and the inlet of the inner passage being disposed near the center of rotation of said distributor and wherein said means for feeding fuel, said distributor, and said passages are arranged and constructed so that the fuel is classified with coarse fuel being delivered through said outer passage and finely sized fuel through said inner passage.

2. An apparatus according to claim 1, wherein the outlet of the inner passage is located below the outlet of the outer passage.

3. An apparatus according to claim 1, wherein the upper side of the distributor includes an adjustable plate between the inlets of the inner and outer passages.

4. An apparatus according to claim 1, wherein an inner passage is juxtaposed to an outer passage such that said inner passage is not aligned to said outer passage by a line drawn from the center of rotation to the edge of said disc-like distributor.

5. An apparatus according to claim 1, wherein said distributor comprises at least two pair of inner and outer passages, each inner passage is juxtaposed to an outer passage such that the inner passage is not aligned to the outer passage to which it is juxtaposed by a line drawn from the center of rotation to the edge of disc-like distributor.

* * * * *